United States Patent [19]

Williams et al.

[11] Patent Number: 4,818,133

[45] Date of Patent: Apr. 4, 1989

[54] HIGH SPEED WIRE MATRIX PRINT HEAD

[76] Inventors: Richard A. Williams, 5 Marilyn Park, Hampstead, N.H. 03841; James T. Busse, 19 Cleveland Hill Rd., Brookline, N.H. 03033

[21] Appl. No.: 863,715

[22] Filed: May 16, 1986

[51] Int. Cl.[4] ..... B41J 3/12

[52] U.S. Cl. ..... 400/124; 101/93.05; 335/274

[58] Field of Search ..... 400/124; 101/93.05; 335/274, 275

[56] References Cited

U.S. PATENT DOCUMENTS

| | | | |
|---|---|---|---|
| 3,836,880 | 9/1974 | Matschke | 400/124 X |
| 3,991,869 | 11/1976 | Berrey | 197/1 R |
| 4,051,941 | 10/1977 | Hebert | 197/1 R |
| 4,079,824 | 3/1978 | Ku | 197/1 R |
| 4,140,406 | 2/1979 | Wolf et al. | 400/124 |
| 4,141,661 | 2/1979 | Geis et al. | 400/124 |
| 4,194,846 | 3/1980 | Zerillo | 400/124 |
| 4,214,836 | 7/1980 | Wang | 400/124 |
| 4,230,038 | 10/1980 | Hebert | 101/93.05 |
| 4,320,981 | 3/1982 | Hariison et al. | 400/124 |
| 4,353,654 | 10/1982 | Shiurila | 400/124 |
| 4,367,962 | 1/1983 | Gaboardi | 400/124 |
| 4,400,102 | 8/1983 | Shiurila et al. | 400/124 |
| 4,407,591 | 10/1983 | Adamoli et al. | 400/124 |
| 4,453,840 | 6/1984 | Hodne | 400/124 |
| 4,459,051 | 7/1984 | Kawai | 400/124 |
| 4,472,071 | 9/1984 | Blomquist et al. | 400/59 |
| 4,473,311 | 9/1984 | Sakaida | 400/124 |
| 4,478,528 | 10/1984 | Hebert | 400/124 |
| 4,568,207 | 2/1986 | Hara | 400/124 |

OTHER PUBLICATIONS

*IBM Tech Disc. Bulletin*, by D. W. Hanna, vol. 24, No. 3, Aug. 1981, pp. 1702–1704.

*Primary Examiner*—Paul T. Sewell

*Attorney, Agent, or Firm*—Wolf, Greenfield & Sacks

[57] ABSTRACT

A wire matrix print head includes a plurality of axially movable print wires, each having an associated electromagnetic actuator comprising an actuating armature and an electromagnet. An E-shaped, laminated pole piece is utilized to obtain extremely high speed operation. The center arm of the E-shaped pole piece includes a portion of reduced width to provide space for the energizing coil, while the inner arm has full width to maximize the actuating force. The armature is pivoted about a point inward of the outer edge of the pole piece and is returned to its standby position by an O-ring prior to the print wire reaching the standby position. The print head includes a print wire guide assembly which imparts a constant radius curvature to each print wire.

2 Claims, 3 Drawing Sheets

HIGH SPEED WIRE MATRIX PRINT HEAD

FIELD OF THE INVENTION

This invention relates to a print head for dot matrix printers and, more particularly, to a wire matrix print head having a construction which provides extremely high speed operation.

BACKGROUND OF THE INVENTION

In a dot matrix printer, a number of print wires are held in a print head in a fixed array. The print head is fixed to a carriage which typically moves within a limited range along a track through the successive printing positions. At each printing position, a predetermined number of print wires is actuated to strike the paper through an inking ribbon to form a portion of a dot matrix of a character on the paper. To actuate the print wires, electrical signals energize a predetermined number of electromagnets which control armatures which propel the wires toward the paper. Both the wires and their electromagnetic actuators are mounted in the print head, which typically has one or two columns of up to twelve wires per column facing the paper. Typically, the actuating ends of the print wires are arranged in a circular array about an axis of the print head. The actuators, including the armatures and the electromagnets, are positioned in a radial arrangement around the actuating ends of the print wires. The armatures extend radially outward from the print wires and the electromagnets are positioned near the outer end of the armature so as to actuate the armature in a generally axial direction and propel the print wire in the direction of the inking ribbon and the paper.

Wire matrix print heads of the above type have been shown and described in the prior art. U.S. Pat. No. 4,051,941 discloses a print head wherein an armature retainer is provided with a peripheral O-ring which bears against the outer ends of the armatures and causes them to pivot about the outermost edge of the electromagnet pole piece to a standby position. A second O-ring absorbs shock when the armature returns from the print position to the standby position. U.S. Pat. No. 4,407,591 discloses the use of pole pieces with generally triangular cross-sections. In addition, this patent discloses the use of a printed circuit board embedded in a resin block for making connections to the coils of the electromagnets.

A major objective in the design of wire matrix print heads is to improve the speed of operation. Since the device is electromechanical, it is inherently slower than the computer or other electronic device which sends data for printing. Therefore, the printer speed is a limiting factor in the operation of the computer system. Wire matrix print heads are usually rated in terms of the speed at which a single wire can be alternated between the standby position and the print position. In prior art print heads, the maximum rate has been on the order of 1,000–1,500 cycles per second. It is generally desirable to increase this speed so as to permit higher speed printer operation.

Another objective in the design of wire matrix print heads is to improve the ease of assembly and reduce the expense of manufacturing. Furthermore, it is desired to eliminate individual print wire adjustments and to provide a precision unit which will operate reliably for long periods.

It is a general object of the present invention to provide a new and improved wire matrix print head.

It is another object of the present invention to provide a wire matrix print head capable of extremely high speed operation.

It is another object of the present invention to provide a wire matrix print head with an electromagnetic actuator having a novel design capable of extremely high speed operation.

It is a further object of the present invention to provide a wire matrix print head with print wire paths carefully selected to minimize friction.

SUMMARY OF THE INVENTION

According to the present invention, these and other objects and advantages are achieved in a high speed wire matrix print head comprising a plurality of print wires, each having a printing end and an actuating end and being axially movable between a print position and a standby position, guide means for supporting the print wires, means for biasing the print wires to the standby position, electromagnetic actuating means for individually actuating selected print wires and means for mounting the actuating means about an axis of the print head. The electromagnetic actuating means includes an armature and an electromagnet associated with each of the print wires. Each electromagnet comprises a generally E-shaped magnetic pole piece having a base and three aligned parallel arms and an energizing coil on the center of the three arms. The actuating means are mounted such that each armature extends radially outward from the actuating end of its associated print wire and each electromagnet is positioned to cause pivoting axial movement of its associated armature. Each E-shaped pole piece is positioned with its arms parallel to the axis of the print head and radially aligned with its associated armature, whereby the E-shaped pole piece exerts a force on the armature near the actuating end of the print wire and provides high speed actuation of the print wire.

It is preferred that the magnetic pole pieces comprise a plurality of magnetic laminations to reduce any current losses and enhance the speed of operation of the print head. It is also preferred that the center arm of the pole piece have a pole face with at least a portion of its width less than the width of the pole face of the inner arm to provide space for the energizing coil while maintaining the inner arm with a large area pole face. Preferably, the armature pivots between the print position and the standby position about a point located radially inward of the outermost edge of the pole piece. The guide means preferably includes a plurality of bulkheads which form the print wires into a path having a curved portion of constant radius.

BRIEF DESCRIPTION OF THE DRAWINGS

For a better understanding of the present invention together with other and further objects, advantages and capabilities thereof, reference may be had to the accompanying drawings in which.

DETAILED DESCRIPTION OF THE INVENTION

Figure 1:
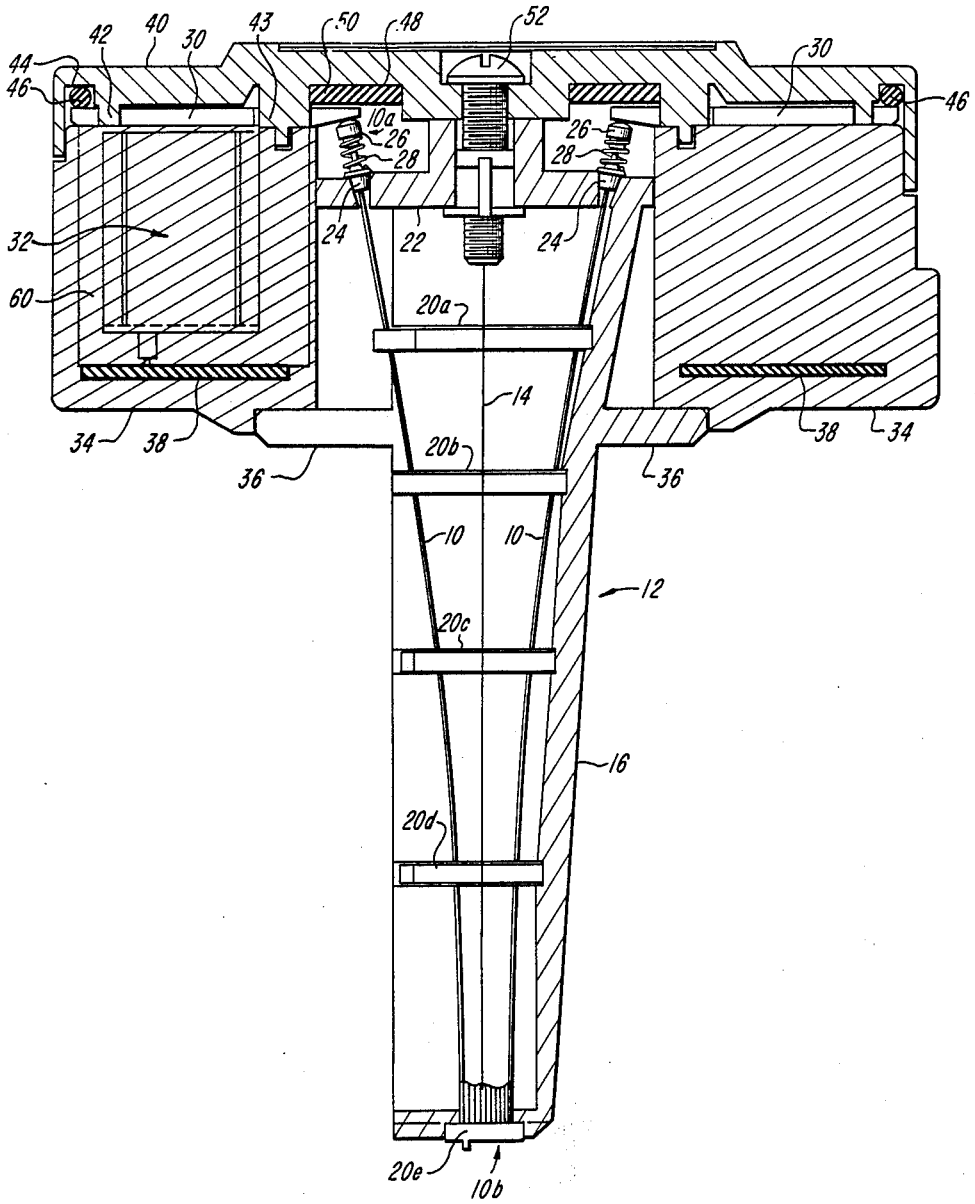
FIG. 1 is a cross-sectional view of a wire matrix print head in accordance with the present invention.
Figure 2:
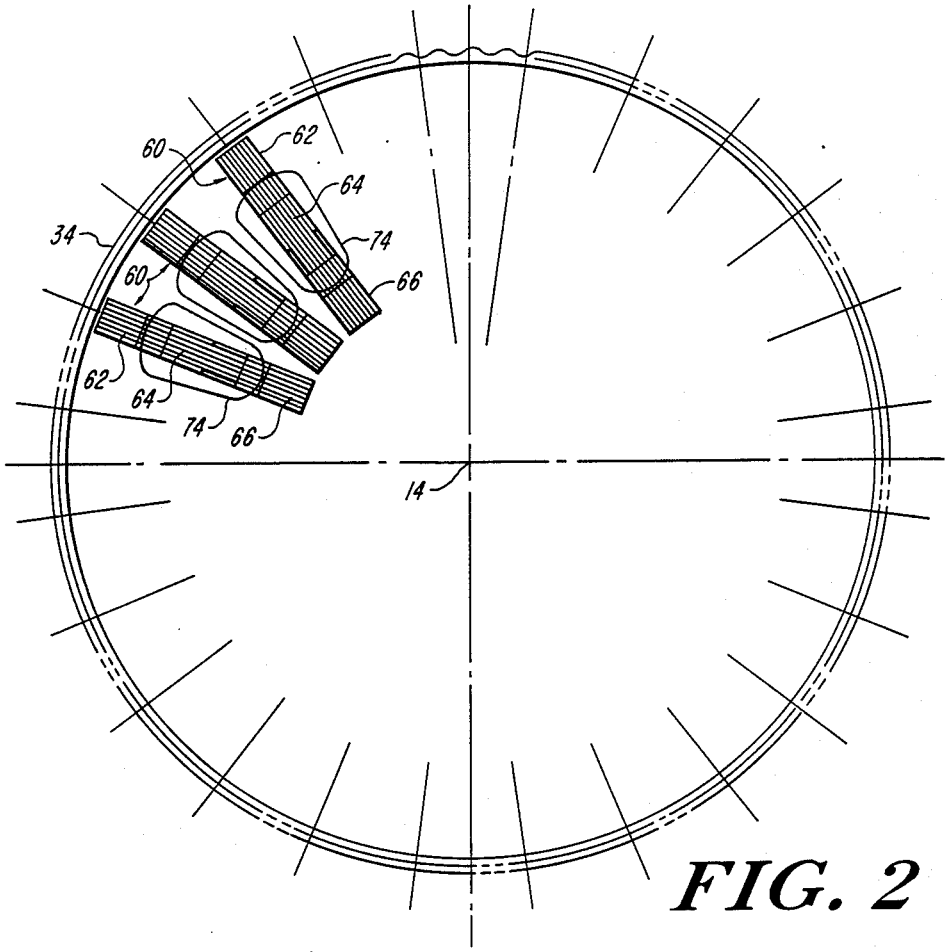
FIG. 2 is a cross-sectional view of the wire matrix print head of FIG. 1 taken perpendicular to the print head axis.

A wire matrix print head in accordance with the present invention is shown in FIGS. 1 and 2. A plurality of print wires 10 each extend from an actuating end 10*a* to a printing end 10*b*. A guide assembly 12 positions and forms the print wires 10 along their length. At the printing end 10*b*, the wires are positioned for matrix printing through an inking ribbon. In the present example, two columns of twelve print wires each comprise the print matrix array. At the actuating end 10*a*, the print wires 10 are arranged in a circular array around an axis 14 of the print head. The guide assembly 12 includes a guide frame 16 and a plurality of bulkheads 20*a*, 20*b*, 20*c*, 20*d* and 20*e*, each having a pattern of holes for passing the print wires 10. The guide frame 16 includes a bulkhead 22 with holes for the print wires 10 near the actuating ends 10*a*. The wires 10 pass through sleeves 24 fitted in the holes in bulkhead 22. The actuating ends 10*a* of the print wires are fitted with end knobs 26. Biasing springs 28 are mounted between the sleeves 24 and the end knobs 26 and bias the print wires 10 away from a print position to a standby position.

The print wires 10 are axially movable through the guide assembly 12, between the print position in which the wire 10 is extended into contact with an inking ribbon (not shown), and the standby position in which the wire 10 is retracted from contact with the inking ribbon by the biasing springs 28.

The print head is provided with electromagnetic actuating means for moving the print wires 10 between the standby position and the print position, when desired for printing. The actuating means includes an armature 30 and an electromagnet 32 associated with each of the print wires 10. When an electromagnet 32 is energized, the armature 30 moves the associated print wire 10 axially to the print position. Each armature 30 extends from the actuating end 10*a* of the associated print wire radially outward from the axis 14. The electromagnets 32 are arranged in a circular array around the print wires 10 and positioned to actuate each armature 30.

An annular actuator housing 34 is retained on the guide frame 16 by a flange 36. The actuator housing 34 is generally cup-shaped with a central opening for passage of the print wires 10. The electromagnets 32 are positioned in a circular array in the housing 34. Also positioned within the housing 34 at the ends of the electromagnets 32 opposite the armatures 30 is a printed circuit board 38, having an annular shape and functioning to connect the coil of each electromagnet 32 to an external energizing source. The actuator housing 34, with the electromagnets 32 and the printed circuit board 38 mounted therein, is filled with a thermally conductive resin for conduction of heat from the actuating assemblies.

A generally disk-shaped armature retainer 40 covers the actuator housing 34 and includes projections 42, 43 which retain each armature 30 in position relative to its associated electromagnet 32 and print wire 10. The armature retainer 40 is provided near its outer periphery with a circular groove 44 which holds an elastomer O-ring 46. The O-ring 46 bears against the outer portion of each armature 30, causing it to be retracted to the standby position as described in more detail hereinafter. The armature retainer 40 also includes a groove 48 for holding an annular resilient pad 50 against which the armatures 30 rest in the standby position. The armature retainer 40, the actuator housing 34 and the guide assembly 12 are held together by a mounting screw 52.

Figure 3:
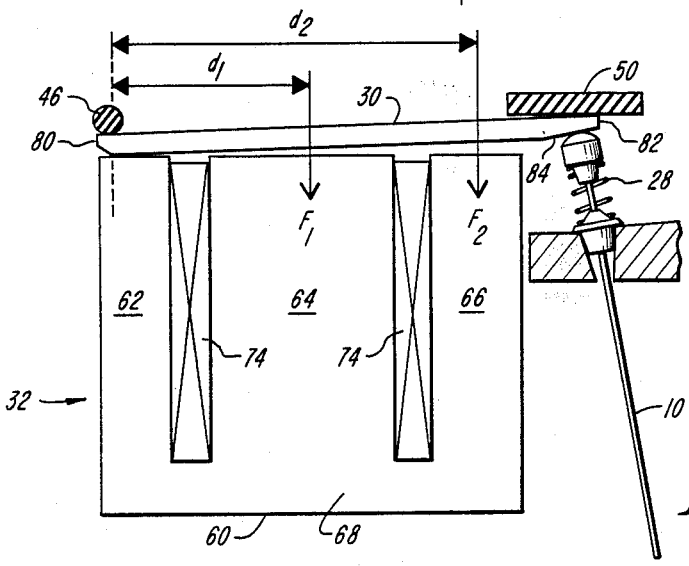
FIG. 3 is a simplified diagrammatic view of an electromagnetic actuator in accordance with the present invention.
Figure 4:
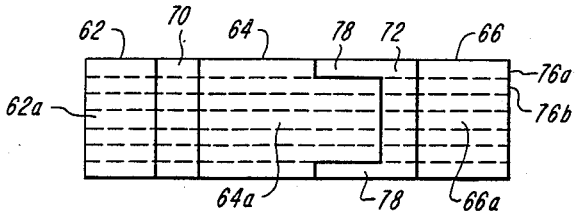
FIG. 4 illustrates a magnetic pole piece used in the electromagnetic actuator of the present invention.

Referring now to FIG. 3, there is shown a simplified diagram of the electromagnetic actuator including the armature 30 and electromagnet 32. The electromagnet 32 includes a generally E-shaped pole piece 60 of magnetic material. The pole piece 60 includes an outer arm 62, a middle arm 64 and an inner arm 66, upstanding from a base 68. The arms 62, 64, 66 include pole faces 62*a*, 64*a*, 66*a*, respectively, which face the armature 30. The outer arm 62 and the middle arm 64 are separated by an outer gap 70, while the middle arm 64 and the inner arm 66 are separated by an inner gap 72. The electromagnet winding, or coil, 74 is wound around the middle arm 64 in the gaps 70, 72. Typically the coil 74 includes 240 turns of 30 gauge wire. In a preferred embodiment, the pole piece 60 is fabricated from laminations 76*a*, 76*b*, etc., as shown in FIG. 4. The laminations can comprise 0.014-inch thick three percent silicon iron. When the pole piece 60 is mounted in the print head, the laminations 76*a*, 76*b*, etc. run in a general radial direction with respect to the axis 14. Portions of the middle arm 64 can be cut away as shown at 78 to provide room for the coil 74 in the generally triangular-shaped space available in the print head. The laminated pole piece construction substantially reduces eddy current losses and enhances the operating speed of the electromagnet 32.

Figure 5:
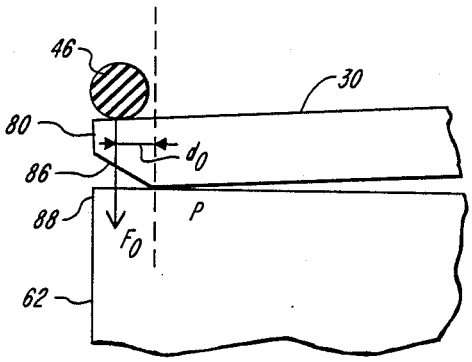
FIG. 5 is an enlarged partial view of the armature and pole piece shown in FIG. 3.

The armature 30 is fabricated of magnetic material and extends from an outer end 80 to an inner end 82 which contacts the actuating end 10*a* of the print wire 10. The armature 30 is wider at the outer end 80 and tapers inwardly to the inner end 82. The inner end 82 is beveled on its lower surface 84 so as to contact the print wire 10 at right angles. The outer end 80 includes a beveled portion 86 on its lower surface as best seen in FIG. 5. The beveled portion 86 is formed by removal of the outermost lower corner of the armature 30, preferably at an angle of about 60°. As a result, the armature 30 is caused to pivot about a point P, spaced radially inward from the outermost edge 88 of the outer arm 62 of pole piece 60. As seen in FIG. 5, the force $F_0$ exerted on the armature 30 by the O-ring 46 acts through a distance $d_0$, thereby tending to pivot the armature 30 about the point P to the standby position. The armature 30 is pivoted by the force $F_0$ exerted by the O-ring 46 independently of any return force exerted on the armature 30 by the spring 28 which urges the print wire 10 toward its standby position. It has been found that the armature 30 is returned to its standby position by the force $F_0$ before the print wire 10 reaches the standby position. This is desirable since the print wire 10 is not required to overcome the inertia of the armature 30 in returning to its standby position. As a result, the speed of operation is enhanced.

In actuating the print wire 10 to its printing position, the coil 74 is energized with an electric current, causing magnetic flux in the arms 62, 64, 66 of the pole piece 60. The middle arm 64 exerts a force $F_1$ as shown in FIG. 3, acting through a distance $d_1$, while the inner arm 66 exerts a force $F_2$, acting through a distance $d_2$. As is known in the art, the energy imparted to the print wire is proportional to the sum of each force multiplied by its distance from the pivot point P. In the apparatus of the present invention, approximately two-thirds of the energy is supplied by the inner arm 66, one-third by the middle arm 64 and a negligible amount by the outer arm 62. The E-shaped pole piece 60 of the present invention provides greatly enhanced energy available for actuating the print wire to the printing position in comparison with prior art U-shaped pole pieces. Not only is the force applied a greater distance from the pivot point, but also additional force is exerted by the additional arm of the pole piece. In one example of the present invention, $d_0$ is approximately 0.020 inch, $d_1$ is approximately 0.570 inch, $d_2$ is approximately 0.410 inch, and the distance between the pivot point P and the print wire is approximately 0.740 inch.

In another important feature of the present invention, the arms 62, 64, 66 of the pole piece 60 are constructed with relatively large non-uniform pole face areas so as to obtain the largest possible actuating force with a pole piece which fits within the sector-shaped space available in the print head. Since the inner arm 66 exerts approximately two-thirds of the energizing force, it is important to maximize the area of its pole face 66*a*. These requirements can be met when the center arm 64 is provided with a pole face 64*a* with at least a portion of its width less than the width of the pole face 66*a* of the inner arm 66. In a preferred embodiment, portions of the middle arm 64 are cut away, as shown at 78, to taper or narrow the pole face 64a toward the axis 14 and to provide room for the coil 74 in the sector-shaped space available, without reducing the area of the pole face 66*a*. A further requirement is that the pole face 64*a* area of the center arm 64 be approximately equal to the sum of the pole face areas 62*a*, 66*a* of the inner arm 62 and the outer arm 66 in order to avoid saturating the pole piece 60. In a preferred embodiment, pole piece 60 is 0.655-inch long by 0.098-inch wide overall as viewed in FIG. 4, and the pole face 66*a* of the inner arm 66 is 0.130-inch by 0.098-inch.

Referring again to FIG. 1, it can be seen that the print wire 10 follows a generally curved path between the printing end 10*b* and the actuating end 10*a*, as determined by the bulkheads 20*a*, 20*b*, 20*c*, 20*d* and 20*e*. Unnecessary friction restricts axial movement of the print wire 10 between its standby position and its printing position and inhibits high speed operation. In a preferred embodiment, the print wire 10 includes a straight segment near the actuating end 10*a* and a straight segment near the printing end 10*b* and an intermediate curved segment of constant radius. As a result, each of the bulkheads 20*a*, 20*b*, 20*c*, 20*d* exerts a force on each of the print wires 10 toward the axis 14 of the print head. This configuration minimizes friction on the print wires 10 and enhances high speed operation.

In operation it has been found that the print head shown and described herein is capable of cycling between the standby position and the printing position at approximately 2,000 cycles per second. This is equivalent to a draft printing rate of approximately 450 characters per second.

While there has been shown and described what is at present considered the preferred embodiments of the present invention, it will be obvious to those skilled in the art that various changes and modifications may be made therein without departing from the scope of the invention as defined in the appended claims.

What is claimed is:

1. A high speed wire matrix print head comprising:

a plurality of print wires each having a printing end and an actuating end and being axially movable between a print position and a standby position;

guide means for supporting said print wires with a desired arrangement of the printing ends and for axial movement between the print position and the standby position;

means for biasing said print wires to the standby position;

electromagnetic actuating means for individually actuating selected print wires from the standby position to the print position, said actuating means including an armature and an electromagnet associated with each of said print wires, each electromagnet comprising a generally E-shaped magnetic pole piece having a base and three aligned parallel arms of substantially the same length extending from the base, and an energizing coil on the center of the three arms; and means for mounting said actuating means about an axis of said print head such that each armature extends radially outward from the actuating end of its associated print wire and each electromagnet is positioned to cause pivoting axial movement of its associated armature, each pole piece being positioned with said arms parallel to the axis of the print head and radially aligned with its associated armature, so that the two inner arms of said E-shaped pole piece urge said armature toward the print position and the innermost arm exerts a force on said armature near the actuating end of the print wire in order to provide high speed actuation of said print wire, each of said pole pieces comprising a plurality of magnetic laminations to reduce eddy current losses and enhance the speed of operation of said print head, said laminations having different sizes in order to shape said pole piece such that said energizing coil is generally sector-shaped when disposed on the center arm of said pole piece and efficiently fits the sector-shaped space available in said print head.

2. A wire matrix print head as defined in claim 1 wherein said laminations comprise a plurality of bonded-together parallel sheets oriented radially with respect to said axis.

* * * * *